US010791850B1

(12) United States Patent
Manuel et al.

(10) Patent No.: US 10,791,850 B1
(45) Date of Patent: Oct. 6, 2020

(54) RETAIL DISPLAY UNIT FOR MULTIPLE SHAPED PRODUCTS

(71) Applicant: Target Brands, Inc., Minneapolis, MN (US)

(72) Inventors: Grace C. Manuel, Minneapolis, MN (US); Jason W. Johnson, Wayzata, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 16/380,113

(22) Filed: Apr. 10, 2019

(51) Int. Cl.

| | |
|---|---|
| ***A47F 5/00*** | (2006.01) |
| ***A47F 5/10*** | (2006.01) |
| ***A47F 5/16*** | (2006.01) |
| ***A47B 96/06*** | (2006.01) |
| ***A47B 47/02*** | (2006.01) |
| ***A47F 5/08*** | (2006.01) |
| ***A47B 96/02*** | (2006.01) |
| ***A47F 7/17*** | (2006.01) |
| ***A47F 7/00*** | (2006.01) |
| ***A47F 7/14*** | (2006.01) |

(52) U.S. Cl.
CPC ..... *A47F 5/0018* (2013.01); *A47B 47/022* (2013.01); *A47B 96/027* (2013.01); *A47B 96/061* (2013.01); *A47F 5/08* (2013.01); *A47F 5/10* (2013.01); *A47F 5/16* (2013.01); *A47F 7/0057* (2013.01); *A47F 7/143* (2013.01); *A47F 7/17* (2013.01)

(58) Field of Classification Search
CPC ..... A47F 5/0018; A47F 5/10; A47F 7/144; A47F 7/145; A47F 7/148; A47F 7/17; A47F 7/175; A47F 7/0007; A47F 5/13; A47F 7/0057; A47F 7/14; A47F 7/143; A47F 5/01; A47F 5/0807; A47F 5/0869; A47F 5/0876; A47F 5/16; A47F 5/08; A47F 2005/165; A47F 1/00; A47F 3/02; A47F 2003/021; A47F 3/004; A47F 5/0025; A47F 5/0031; A47F 5/0043; A47F 5/0056; A47F 5/0062; A47B 47/022; A47B 57/045; A47B 57/42; A47B 57/46; A47B 57/56; A47B 96/027; A47B 96/06; A47B 96/061; A47B 96/067
USPC .... 211/90.04, 90.03, 90.01, 59.2, 49.1, 57.1, 211/59.1, 44, 133.3, 75, 88.01, 193; 108/25; 312/330.1
See application file for complete search history.

(56) References Cited

U.S. PATENT DOCUMENTS 618,425 A * 1/1899 Manger ..... A47K 5/02 211/85.12
1,198,184 A * 9/1916 Bonnabeau ..... A47K 5/02 211/85.12

(Continued)

*Primary Examiner* — Jennifer E. Novosad
(74) *Attorney, Agent, or Firm* — Leanne Taveggia Farrell; Westman, Champlin & Koehler, P.A.

(57) ABSTRACT

A retail display unit includes a base having a frame member and a bracket coupled to the frame member and a holder. The bracket is configured to mount to a retail display fixture. The holder is coupled to the frame member and includes a front, a back, opposing sides, a bottom and is configured to hold and display products of different shapes. The bottom of the holder includes a first curved surface, a second curved surface and a channel located between the first and second curved surfaces and extends from the front to the back of the holder.

19 Claims, 9 Drawing Sheets

(56) References Cited

U.S. PATENT DOCUMENTS 1,374,451 A * 4/1921 Heyman ..... D06F 53/005 312/73
1,857,522 A * 5/1932 Ungeheuer ..... A47B 13/16 220/8
2,489,543 A * 11/1949 Sanford ..... A47K 5/02 312/351
2,517,829 A * 8/1950 Beckovich ..... A47G 23/0241 248/311.2
2,733,113 A * 1/1956 Humbargar ..... A47B 81/007 312/249.7
2,825,466 A * 3/1958 Shnitzler ..... A47F 7/0007 211/49.1
3,185,537 A * 5/1965 Wright ..... A47K 5/02 312/351
3,495,718 A * 2/1970 Romero ..... A47F 5/01 211/88.01
3,549,019 A 12/1970 Wood et al.
3,667,826 A 6/1972 Wood et al.
4,109,797 A * 8/1978 Brunette ..... A47F 5/12 108/108
4,154,356 A * 5/1979 Schieve ..... A47F 5/0823 211/88.01
4,228,903 A * 10/1980 Eckert ..... A47F 1/12 193/2 D
4,294,364 A * 10/1981 Bilbrey ..... F24B 15/00 211/182
4,705,175 A * 11/1987 Howard ..... A47F 5/103 108/109
4,832,607 A * 5/1989 Dorrell ..... A47F 5/103 211/133.3
4,874,210 A * 10/1989 Carroll ..... A47F 5/0018 312/257.1
4,969,560 A * 11/1990 Stanfield ..... A47L 15/505 211/175
5,000,124 A * 3/1991 Bergen ..... A01K 5/0114 119/63
5,022,577 A * 6/1991 Fike ..... A47F 7/17 225/39
5,082,125 A * 1/1992 Ninni ..... A47F 5/0823 108/61
5,086,931 A * 2/1992 Cobb ..... A47F 7/06 211/32
5,197,611 A * 3/1993 Walton ..... A47K 10/22 211/106
5,253,770 A * 10/1993 Rosenthal ..... A47F 5/0025 211/106
5,318,187 A * 6/1994 Rosenthal ..... A47F 5/0823 211/187
5,318,190 A * 6/1994 Mason ..... A47F 7/0064 211/175
5,333,745 A * 8/1994 Lehmann ..... A47F 5/08 211/184
5,361,937 A * 11/1994 Wiese ..... A47F 1/08 211/150
5,367,823 A * 11/1994 Ferris ..... A47F 7/0078 47/39
5,480,039 A * 1/1996 Merl ..... A47B 57/16 211/133.5
5,495,653 A * 3/1996 Schrock ..... A47F 7/005 206/394
5,509,541 A * 4/1996 Merl ..... A47B 45/00 211/103
5,511,675 A * 4/1996 Frederick ..... A47B 63/00 211/162
5,538,230 A * 7/1996 Sibley ..... A47F 7/0014 211/41.18
5,598,932 A * 2/1997 Weidert ..... A47F 3/0486 211/41.1
5,664,690 A * 9/1997 Friesen ..... A47F 5/0823 211/106
5,875,902 A * 3/1999 Emery ..... A47B 96/16 108/29
6,003,692 A * 12/1999 Kozak ..... A47F 5/0031 211/128.1
6,116,434 A * 9/2000 Park ..... A47B 81/00 211/71.01
6,161,708 A * 12/2000 Myler ..... A47F 5/0031 211/106
6,170,674 B1 * 1/2001 Caterinacci ..... A47F 7/0042 211/41.1
6,412,647 B1 * 7/2002 Ko ..... A47B 55/02 211/106
6,497,185 B1 * 12/2002 Barrett ..... A47B 96/025 108/108
6,575,315 B2 * 6/2003 Zidek ..... A47F 5/01 211/106
6,883,671 B2 * 4/2005 Rushing ..... A47F 5/0018 206/736
6,889,854 B2 5/2005 Burke
6,905,034 B2 * 6/2005 Jones ..... A47F 5/02 211/85.18
7,004,334 B2 * 2/2006 Walsh ..... A47F 7/28 211/75
7,014,280 B2 3/2006 Borgen et al.
7,017,778 B2 * 3/2006 Halbherr ..... A47F 1/126 211/59.3
7,063,217 B2 6/2006 Burke
7,140,499 B2 11/2006 Burke
7,175,034 B2 2/2007 Nook et al.
7,278,544 B2 * 10/2007 Blateri ..... B65H 16/005 211/12
7,334,853 B2 * 2/2008 Ahmed ..... F25D 23/04 211/106
7,434,699 B2 * 10/2008 Stukenberg ..... A47G 1/1646 211/41.1
7,497,533 B2 * 3/2009 Remmers ..... A47B 57/42 108/108
7,624,881 B2 * 12/2009 Wilfong, Jr. ..... B65D 83/08 211/59.1
7,628,895 B2 * 12/2009 Buitron et al. ..... H01L 21/677 204/192.2
7,971,737 B2 * 7/2011 Newbould ..... A47B 96/027 211/119.009
8,186,635 B2 * 5/2012 DeVito ..... A47F 5/0823 248/220.21
8,322,584 B2 * 12/2012 Dethmers ..... B60H 1/00592 224/268
8,474,632 B2 * 7/2013 Yang ..... A47K 3/281 211/119.009
8,720,702 B2 * 5/2014 Nagel ..... A47B 96/027 211/59.3
8,839,980 B2 * 9/2014 Baines ..... A47K 3/281 211/90.03
9,883,742 B2 * 2/2018 Yang ..... A47K 1/09
9,980,582 B1 * 5/2018 Levy ..... A47F 5/0018
10,306,998 B2 * 6/2019 Meherin ..... B65D 5/5253
2001/0047973 A1 * 12/2001 Schmidt ..... A47F 5/16 211/90.04
2004/0011752 A1 * 1/2004 Zadak ..... A47F 5/0043 211/90.03
2004/0099622 A1 * 5/2004 Lee ..... A47F 3/004 211/85
2008/0000859 A1 * 1/2008 Yang ..... A47B 57/26 211/90.02
2008/0237159 A1 * 10/2008 Bray ..... A47F 5/0018 211/59.2
2009/0065453 A1 * 3/2009 Smith ..... B42F 7/12 211/11
2010/0026156 A1 * 2/2010 Leconte ..... A47B 96/021 312/408
2010/0176075 A1 * 7/2010 Nagel ..... A47F 1/126 211/59.3
2014/0110364 A1 * 4/2014 Vogel ..... A47F 7/28 211/74
2014/0238947 A1 * 8/2014 Hao ..... A47B 96/06 211/88.01

(56) References Cited

U.S. PATENT DOCUMENTS

| | | | | |
|---|---|---|---|---|
| 2014/0263114 | A1* | 9/2014 | LaMontagne ..... | A47F 5/103<br>211/71.01 |
| 2014/0319086 | A1* | 10/2014 | Sosso ..... | A47F 1/125<br>211/59.3 |
| 2016/0194107 | A1 | 7/2016 | Tran et al. | |

* cited by examiner

RETAIL DISPLAY UNIT FOR MULTIPLE SHAPED PRODUCTS

BACKGROUND

Retail stores use a variety of display fixtures and display structures to present products to customers for purchase. These display fixtures can receive the display structure that support product, indicate the product price and include signage and graphics for highlighting the product. Exemplary display fixtures include gondolas and exemplary display structure include shelves, trays, racks, crossbars, peg hooks and other similar display structures.

The discussion above is merely provided for general background information and is not intended to be used as an aid in determining the scope of the claimed subject matter.

SUMMARY

A retail display unit includes a base having a frame member and a bracket coupled to the frame member that is configured to mount to a retail display fixture. The retail display unit also includes a holder coupled to the frame member and including a front, a back, opposing sides, a bottom. The holder is configured to hold and display products of different shapes. The bottom of the holder includes a first curved surface, a second curved surface and a channel located between the first and second curved surfaces and extends from the front to the back of the holder.

A retail display unit includes a continuous loop member, a bracket and a holder. The loop member includes a fixed portion, a free portion and a pair of parallel portions that couple the fixed portion to the free portion and define a length of the loop member. The bracket is coupled to the fixed portion of the loop member and is configured to mount the loop member to a crossbar on a retail display fixture. The holder is coupled to the pair of parallel portions of the loop member. The holder includes a front, a back, opposing sides, a bottom and is configured to hold and display products of different shapes. The bottom of the holder includes an aperture that extends from the front to the back of the holder.

A retail display fixture includes at least one crossbar and at least one retail display unit configured to hold and display products of different shapes. The retail display unit includes a frame member, a bracket coupled to the frame member and a holder coupled to the frame member. The bracket is configured to mount the frame member to the at least one crossbar. The holder includes a front, a back, opposing sides, a bottom and is configured to hold and display products of different shapes. The bottom includes a channel that extends from the front to the back of the holder.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Using a single type of retail display unit to display multiple shaped products especially products that are related to or are sold together in the same product group makes it easier and more efficient to display merchandise in a retail store. For example, paper napkins and paper plates are sold together in a product group and are coordinated together in pairings, however, a package of paper napkins may be rectangular or square in shape, while a package of papers plates may be round in shape. It is possible for a package of papers plates to also have a rectangular or square shape, but often they are of a different size than the size of the rectangular or square napkins.

Figure 1:
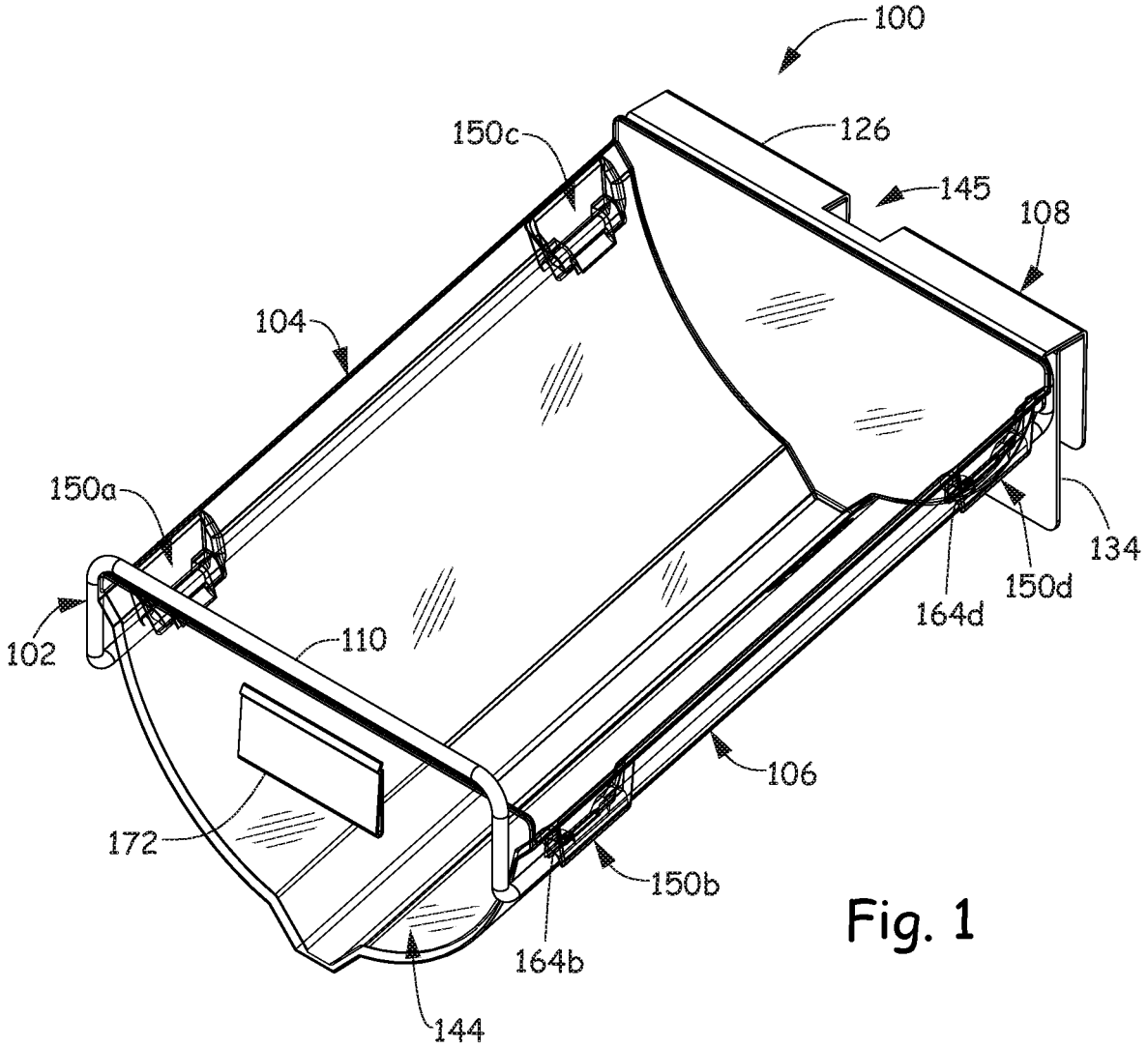
FIG. 1 is a perspective view of a retail display unit.
Figure 2:
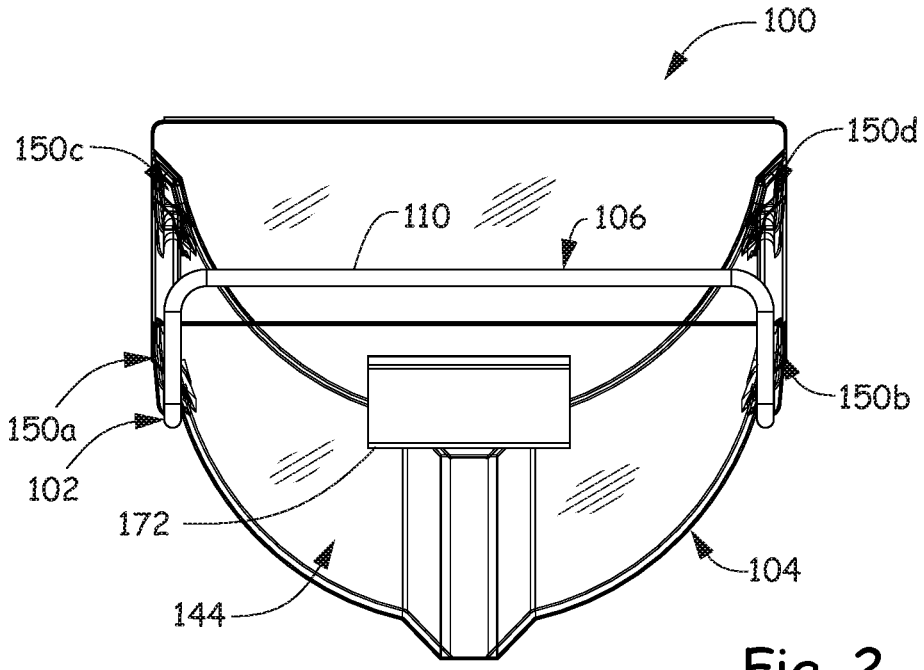
FIG. 2 is a front view of FIG. 1.
Figure 3:
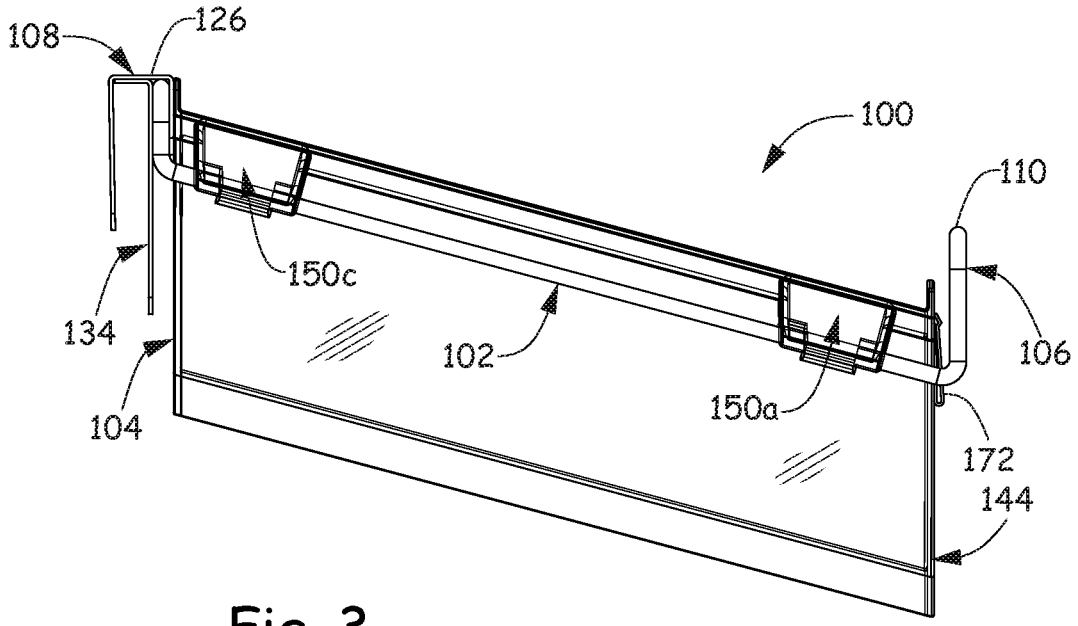
FIG. 3 is a left side view of FIG. 1.
Figure 4:
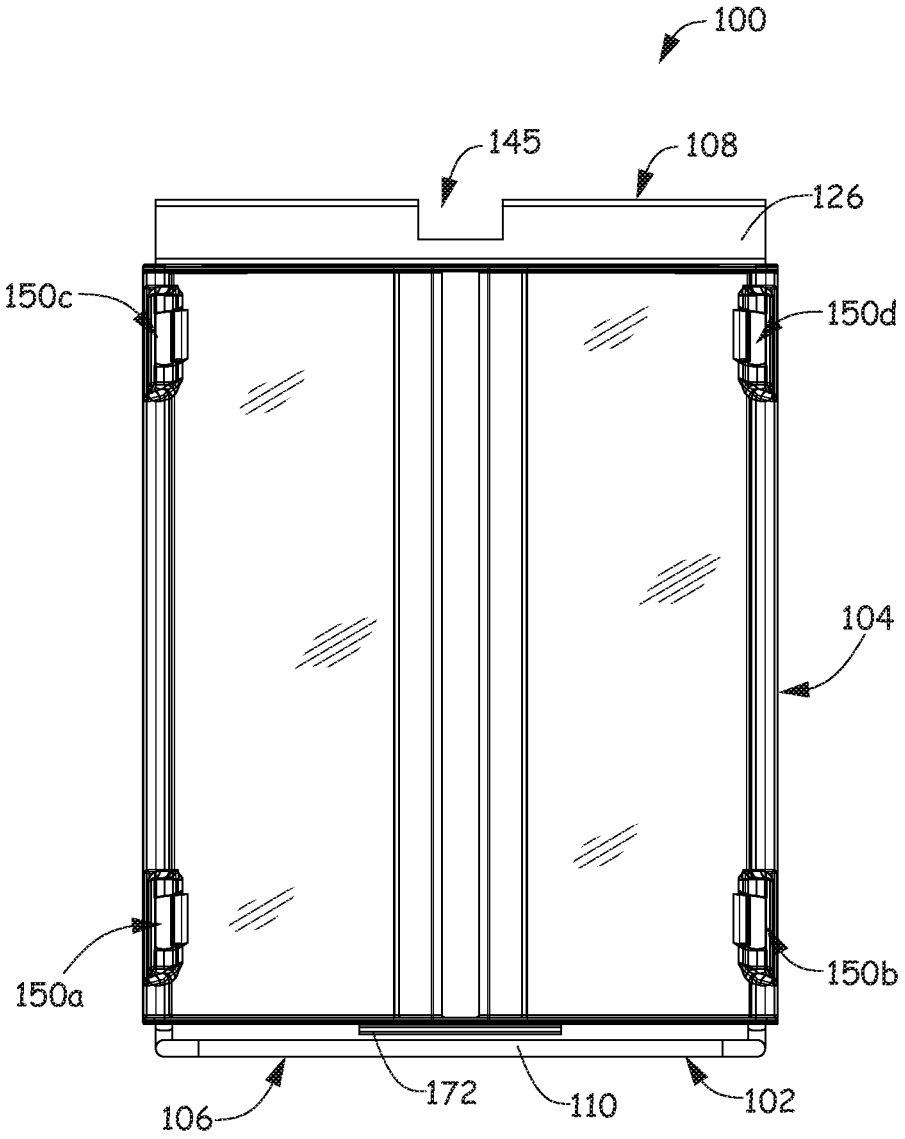
FIG. 4 is a top view of FIG. 1.

Embodiments described herein include a retail display unit for mounting to a crossbar of a display fixture, such as a gondola display fixture, located in a retail store. FIG. 1 is a perspective view of a retail display unit 100. FIG. 2 is a front view, FIG. 3 is a left side view and FIG. 4 is a top view of retail display unit 100. Retail display unit 100 includes a base 102 and a holder 104. Holder 104 is coupled to base 102 and both base 102 and holder 104 will be discussed in detail below.

Figure 5:
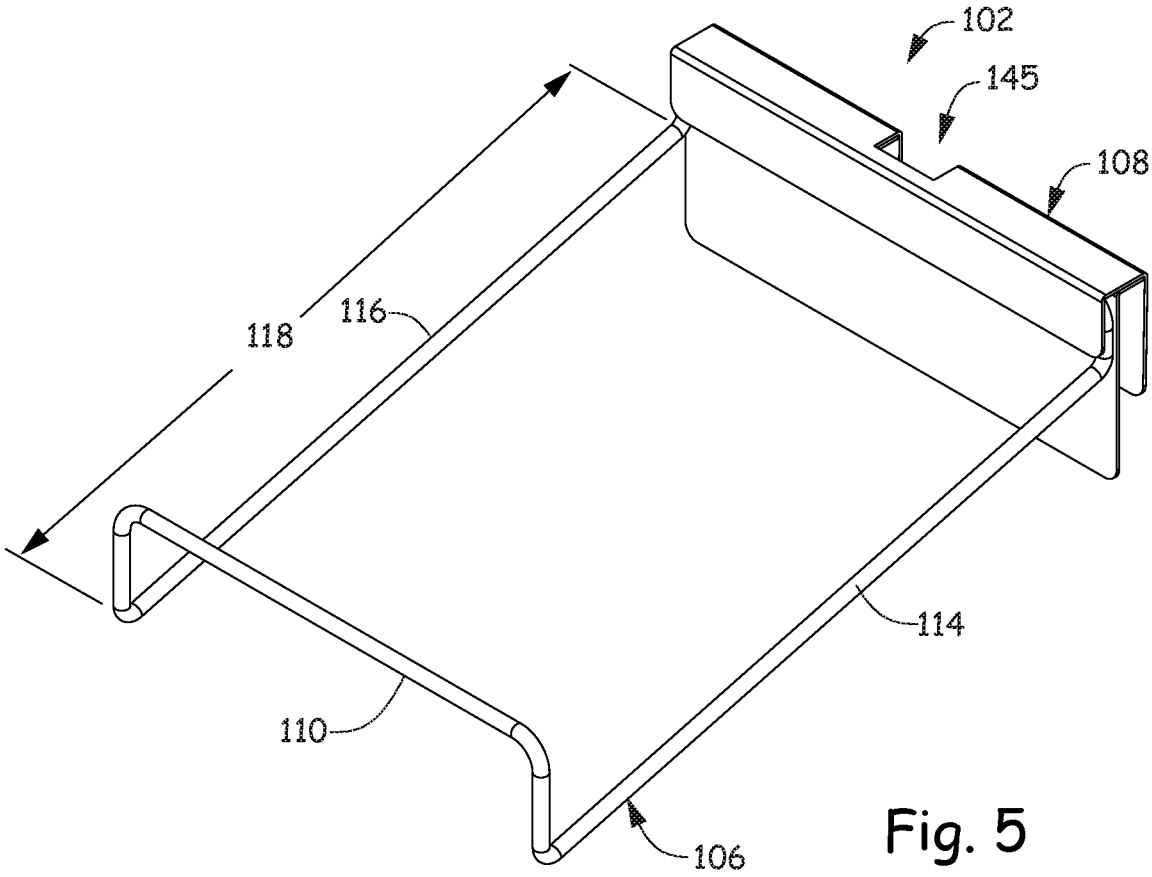
FIG. 5 is a perspective view of a base of the retail display unit.
Figure 6:
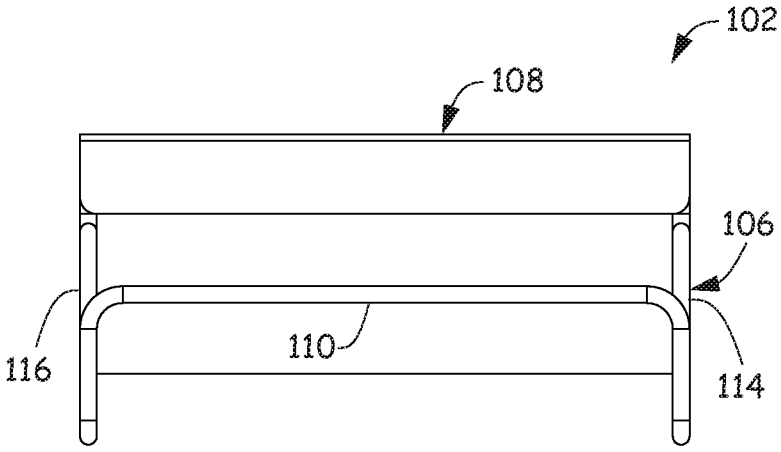
FIG. 6 is a front view of FIG. 5.
Figure 7:
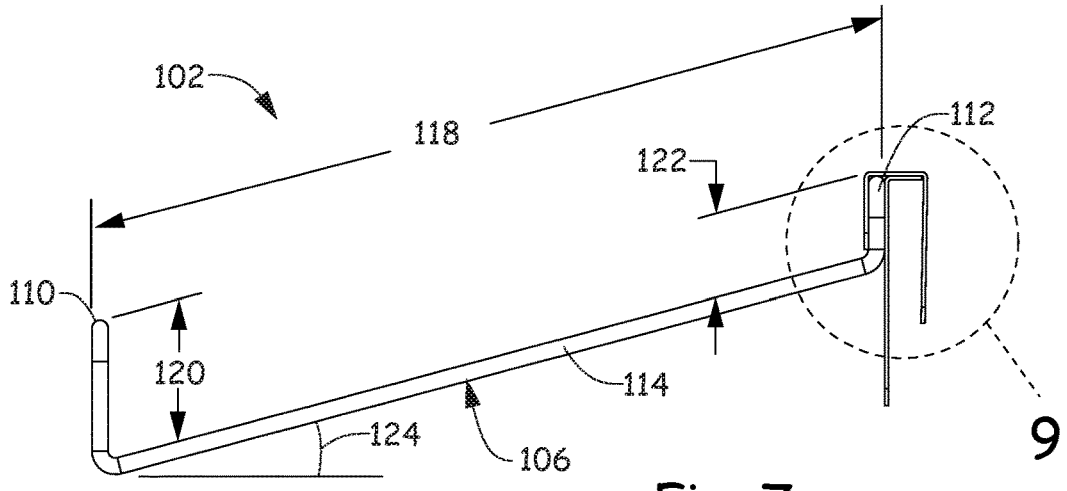
FIG. 7 is a right side view of FIG. 5.
Figure 8:
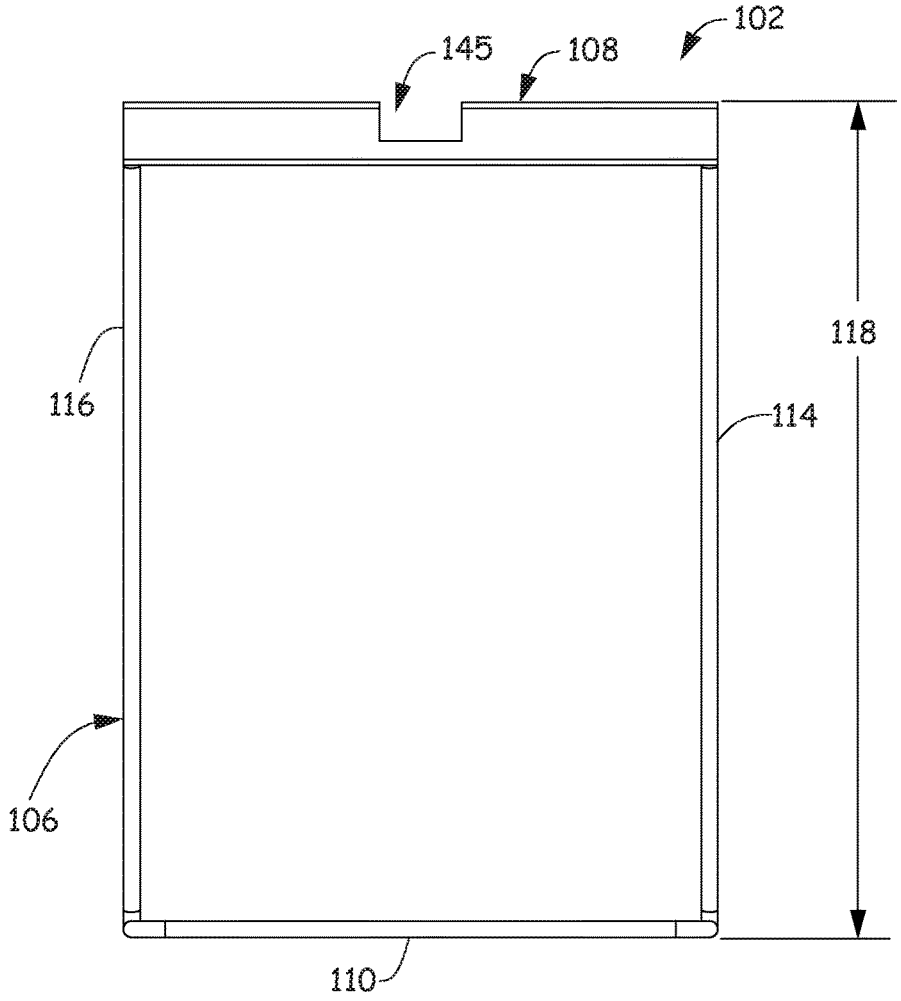
FIG. 8 is a top view of FIG. 5.

FIG. 5 illustrates a perspective view of base 102 of retail display unit 100, FIG. 6 is a front view of base 102, FIG. 7 side view of base 102 and FIG. 8 is a top view of base 102. For purposes of illustration and clarity, FIGS. 5-8 show base 102 without holder 104. Base 102 includes a frame or loop member 106 and a bracket 108 coupled to frame or loop member 106. In one embodiment, frame or loop member 106 is a continuous loop made of metal wire stock. However, it should be realized that other types of materials can be used including various types of extruded polymers.

Frame or loop member 106 includes a free or distal portion 110, a fixed or proximal portion 112 (illustrated in FIG. 7) and a pair of parallel portions 114 and 116 that define a length 118 of frame or loop member 106 and are integrally connected at free or distal portion 110 and at fixed or proximal portion 112. A majority of free or distal portion 110 is located a distance 120 above parallel portions 114 and 116 as well as a majority of fixed or proximal portion 112 being located a distance 122 above parallel portions 114 and 116. In addition, parallel portions 114 and 116 are oriented at an angle 124 from horizontal. For example, angle 124 is 15 degrees. However, other angles are possible as long as the angle allows a guest or customer to easily see the products being displayed in display unit 100.

Figure 9:
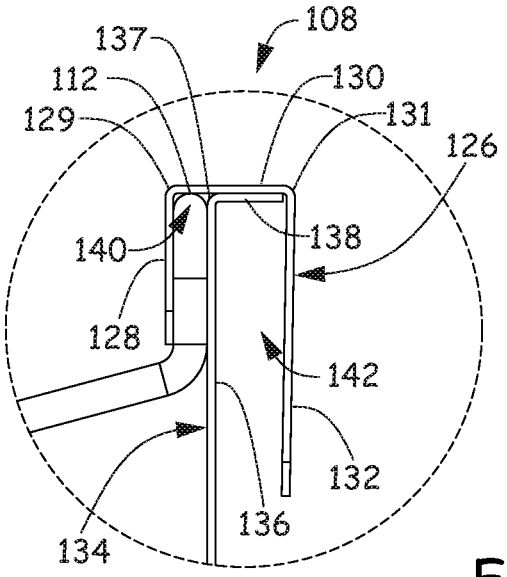
FIG. 9 is an enlarged view of a portion of the base of the retail display unit as indicated in FIG. 7.

FIG. 9 illustrates an enlarged view of a portion of base 102 as indicated in FIG. 7. Bracket 108 is coupled to fixed or proximal portion 112 of frame or loop member 102 and is configured to mount to a retail display fixture such as mounted to a crossbar on a retail display fixture. Bracket 108 includes a plurality of bent plates. An outer plate 126 includes a front section 128, a top section 130 and a back section 132. Front section 128 is connected to top section 130 by a first bend 129 and top section 130 is connected to back section 132 by a second bend 131. An inner plate 134 includes a lower section 136 and an upper section 138. Lower section 136 is connected to upper section 138 by a first bend 137.

Outer plate 126 is coupled to inner plate 134. In particular, upper section 138 of inner plate 134 is directly coupled to a bottom of top section 130 of outer plate 126. The length of upper section 138 is smaller than top section 130 so a space 140 is created between lower section 136 of inner plate 134 and front section 128 of outer plate 126 and a space 142 is created between lower section 136 of inner plate 134 and back section 132 of outer plate 126. Proximal portion 112 of loop member 106 is welded to a bottom of outer plate 126 and inner plate 124 so that proximal portion 112 is located in space 140 between lower section 136 of inner plate 134 and front section 128 of outer plate 126. Space 142 is configured to receive a crossbar on a retail display fixture, for example a crossbar on a gondola display fixture.

As illustrated in FIGS. 5 and 8, bracket 108 also includes a notch 145. Notch 145 means that both outer plate 126 and inner plate 134 each have a notch that align with each other at notch 145. Notch 145 allows retail display unit 100 to span two crossbars that are in alignment with each other on a gondola display fixture. This means that retail display unit 100 may be simultaneously hung on or mounted to a first crossbar and a second crossbar located adjacent to the first crossbar in the case of two side-by-side gondola units being located adjacent to each other with crossbars in alignment with each other.

Figure 10:
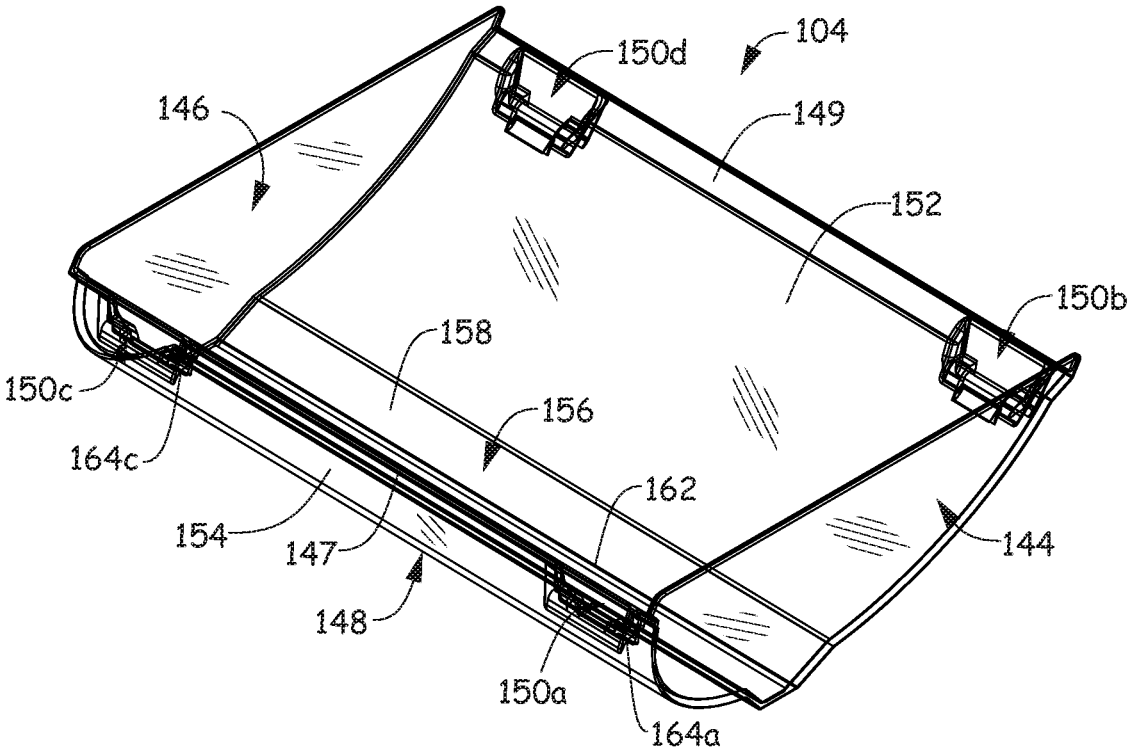
FIG. 10 is a perspective view of a holder of the retail display unit.
Figure 11:
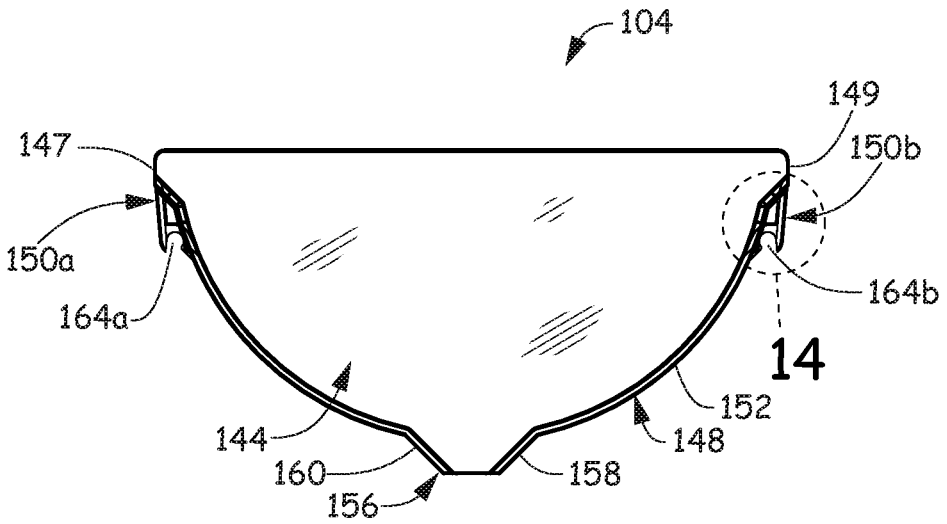
FIG. 11 is a front view of FIG. 10.
Figure 12:
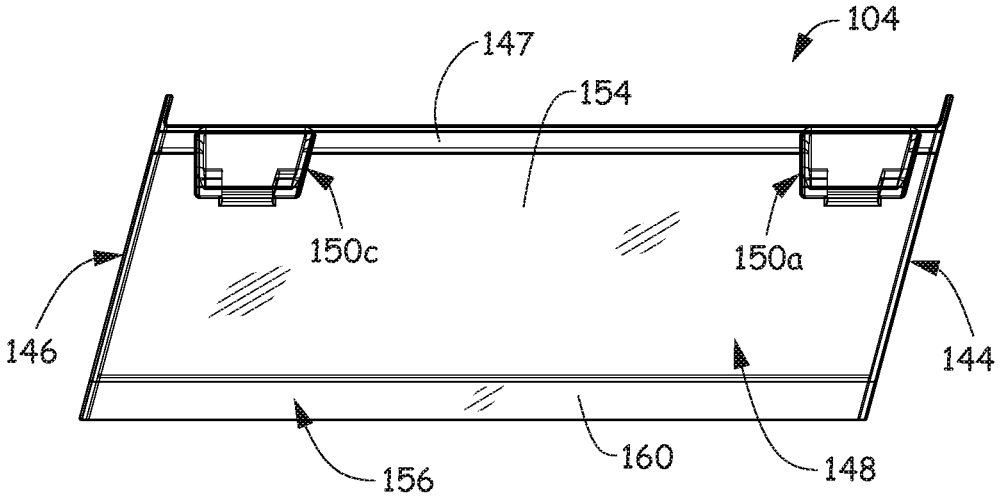
FIG. 12 is a left side view of FIG. 10.
Figure 13:
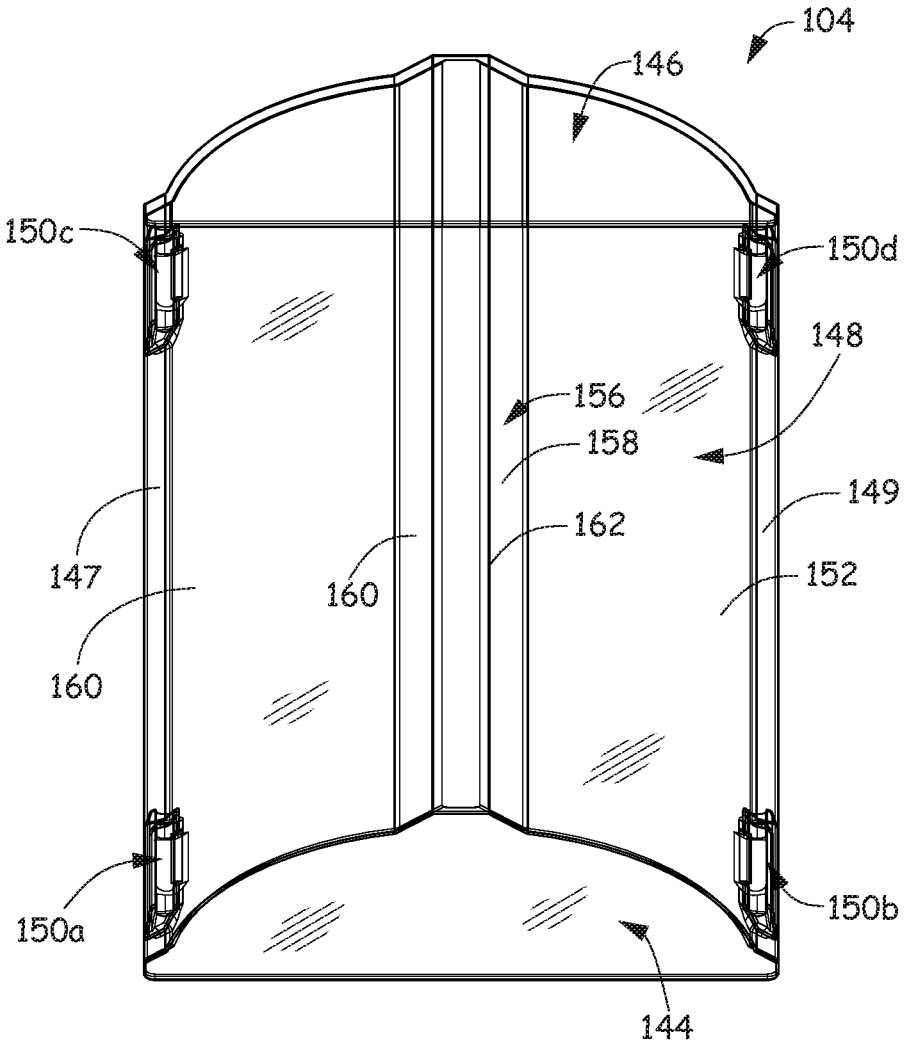
FIG. 13 is a top view of FIG. 10.

FIG. 10 is a perspective view of holder 104 of retail display unit 100, FIG. 11 is a front view of holder 104, FIG. 12 is a left side view of holder 104 and FIG. 13 is a top view of holder 104. For purposes of illustration and clarity, FIGS. 10-14 show holder 104 without base 102. Holder 104 is configured to hold and display product of different shapes. Holder 104 includes a front 144, a back 146, a bottom 148, a first side 147 and a second side 149. Bottom 148 extends from front 144 to back 146, between first side 147 and second side 149 and includes a multi-surface profile. The multi-surface profile of bottom 148 includes a first curved surface 152 having a radius of curvature, a second curved surface 154 having a radius of curvature and a channel 156 located between first curved surface 152 to second curved surface 154 and extends from front 144 to back 146 of holder 104.

In one embodiment and as illustrated, the radius of curvature of second curved surface 154 is substantially the same as the radius of curvature of first curved surface 152. Channel 156 includes first angled side 158, second angled side 160 and an aperture 162 located along the entirety of a bottom of channel 156. The shape of the multi-surface profile of bottom 148 provides holder 104 with the ability to receive a variety of different shaped products including where a portion of a product extends through aperture 162 when on display in holder 104. Such differently shaped products will be discussed in detail below. In addition and in accordance with another embodiment, holder 104 may be made of a transparent molded plastic. In this way not only does multi-surface profile of bottom 14 provide holder 104 with the ability to receive different shaped products, but the products received by holder 104 can be easily viewed through holder 104.

Holder 104 is coupled to the pair of parallel portions 114 and 116 with a plurality of locking features 150*a*, 150*b*, 150*c* and 150*d* located on holder 104. Locking features 150*a* and 150*c* form partially with first side 147 and partially protrude from an outer side of first curved surface 152. Locking features 150*b* and 150*d* form partially with second side 149 and partially protrude form an outer side of second curved surface 154. Each of locking features 150*a*, 150*b*, 150*c* and 150*d* includes a receiver 164*a*, 164*b* and 164*c* (the receiver of locking feature 150*d* is hidden from view in FIGS. 10-13).

Figure 14:
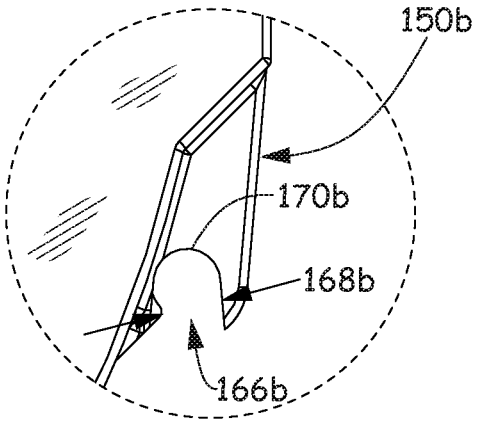
FIG. 14 is an enlarged view of a portion of the holder of the retail display unit as indicated in FIG. 11.

FIG. 14 is an enlarged view of a portion of holder 104 of the display unit as indicated in FIG. 11. In particular, FIG. 14 illustrates an enlarged view of locking feature 150*b*, which is representative of all locking features of holder 104. Receiver 150*b* includes a throat 166*b* having a throat distance 168*b* and a seat 170*b*. Receiver 150*b* is configured to receive a section of frame or loop member 106 of base 102 by pushing the section of frame or loop member 106 through throat 166*b* to sit in seat 170*b*. Throat distance 168*b* is less than a diameter of seat 170*b*.

With reference back to FIGS. 1-4, holder 104 is coupled to base 102 by snap fitting a section of frame or loop member 106 into each receiver 164*a*, 164*b*, 164*c* and 164*d* of each locking feature 150*a*, 150*b*, 150*c* and 150*d*. As illustrated, free or distal portion 110 of frame or loop member 106 is located upwardly from parallel portions 114 and 116 so that free or distal portion 110 runs along a top of front 144 of holder 104. In this way, front 144 is free of base 102 and includes sign sleeve 172 adhered, for example, to a front surface of front 144. Sign sleeve 172 is configured to receive a sign showing price or retail information of the products being displayed in holder 104. Fixed or proximal portion 112 of frame or loop member 106 is located upwardly from parallel portions 114 and 116 so that fixed or proximal portion 112 is welded to at least a bottom of outer plate 126.

Figure 15:
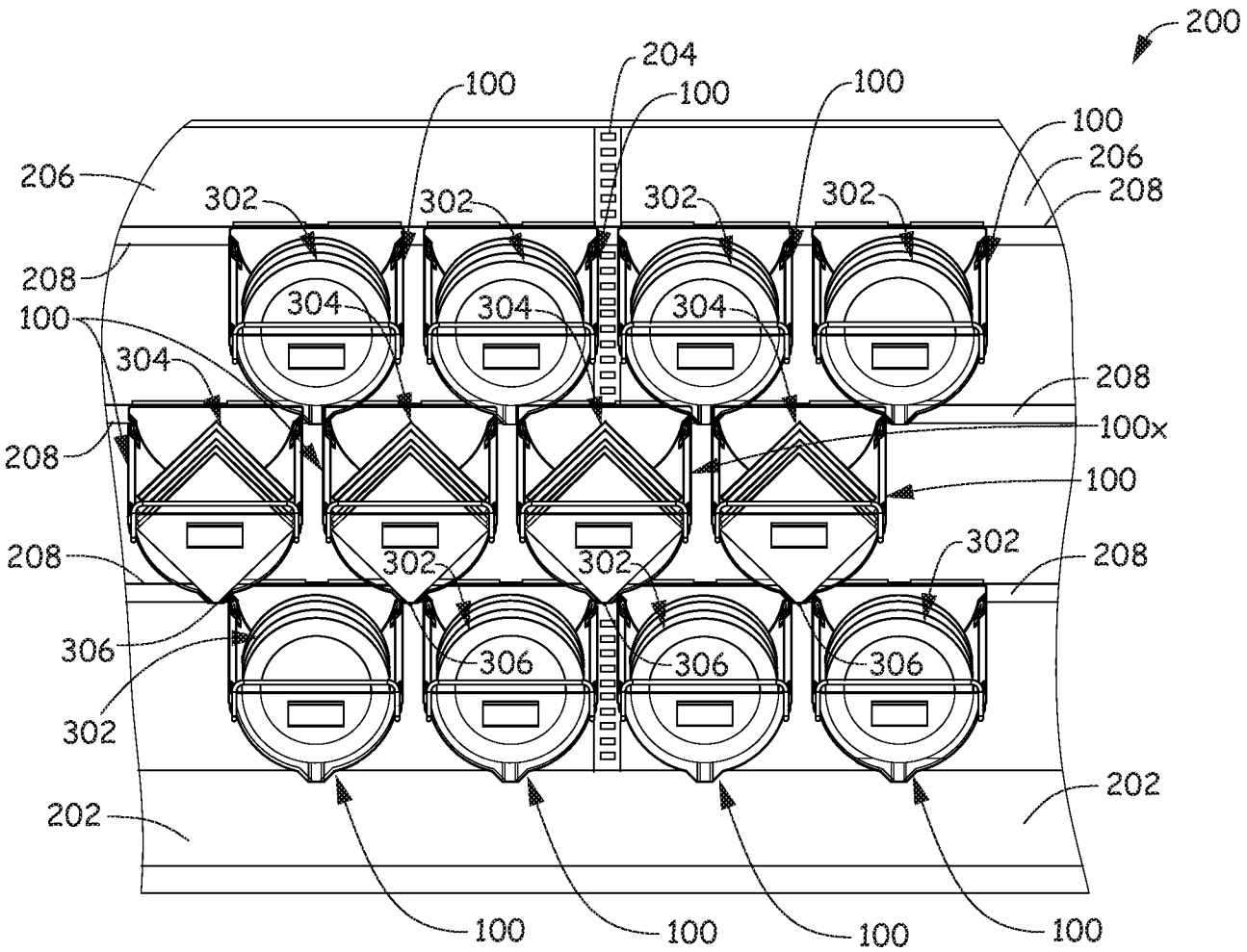
FIG. 15 is a perspective view of a retail display fixture with a plurality of retail display units.

FIG. 15 is a perspective view of a retail display fixture 200 with a plurality of retail display units 100 displaying a variety of differently shaped products. In one embodiment and as illustrated in FIG. 15, retail display fixture 200 is a gondola display fixture. Gondola display fixture 200 includes base decks 202, uprights 204, back walls 206 located between uprights and is configured to receive various types of retail display structures, such as shelves or crossbars for supporting and displaying merchandise. As illustrated in FIG. 15, a plurality of crossbars 208 are mounted to uprights 204 on retail display fixture 200. Another such retail display structure may be retail display unit 100 or a plurality of retail display units 100 that are hung on or mounted to the plurality of crossbars 208. As previously discussed, each retail display unit 100 would hang on or mount to a crossbar 208 such that the crossbar is located in space 142 of bracket 108. As also previously discussed, retail display units 100 are configured to display multiple shaped products.

In FIG. 15, packages of round plates 302 may be displayed in retail display units 100. These plates may be of varying size including plates having a radii that coincides with the radius of curvature of first curved surface 152 and second curved surface 154 to plates having radii that are smaller than the radius of curvature of first curved surface 152 and second curved surface 154. In addition, retail display units 100 may display packages of square or rectangular napkins 304. Packages 304 are cradled in retail display units 100 with a corner 306 of the package 304 protruding through aperture 162 in channel 156 and two of the other corners in contact with other surfaces of holder 104, such as first side 147 and second side 149 or even first curved surface 152 and second curved surface 154.

Also illustrated in FIG. 15 is retail display unit 100*x* spanning two adjacent crossbars 308. As illustrated, crossbars 308 are mounted to uprights 204 in retail display fixture 200. This means that crossbars 308 cannot span across an upright. However, each retail display unit 100 is capable of spanning two adjacent crossbars 308. This is made possible and as previously discussed above, by notch 145. Notch 145 in bracket 108 allows retail display unit 100*x* to pass over an upright 204 so that part of the bracket 108 engages with a first crossbar and another part of the bracket 108 engages with an adjacent second crossbar.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a base including a frame member and a bracket coupled to the frame member that is configured to mount to a retail display fixture;

a holder coupled to the base and including an interior, an exterior, a front, a back, opposing sides, a bottom and configured to hold and display products of different shapes, wherein the bottom comprises:

a first curved surface;

a second curved surface;

a channel located between the first and second curved surfaces and extending from the front to the back of the holder, wherein the channel includes first and second sides, an open top that intersects with the interior and a bottom; and a plurality of locking features that at least partially protrude from the exterior to mate with the frame member of the base.

2. The retail display unit of claim 1, wherein the frame member comprises a continuous loop member having a proximal portion and a distal portion, wherein the proximal portion is coupled to the bracket.

3. The retail display unit of claim 2, wherein the continuous loop member further comprises a pair of parallel portions that extend between the proximal portion and the distal portion.

4. The retail display unit of claim 3, wherein the pair of parallel portions extend from the proximal portion to the distal portion at an angle from horizontal.

5. The retail display unit of claim 3, wherein the holder is coupled to the pair of parallel portions of the frame member with the plurality of locking features located on the holder.

6. The retail display unit of claim 1, wherein the holder is transparent.

7. The retail display unit of claim 1, wherein plurality of locking features at least partially protrude from the exterior of the first and second curved surfaces of the holder.

8. The retail display unit of claim 7, wherein each locking feature comprises a throat and a seat and is configured to snap fit to the frame member.

9. The retail display unit of claim 1, wherein the holder further comprises an aperture located along the entirety of the bottom of the channel that extends from the front to the back of the holder, wherein the aperture is configured such that a portion of a product extends through the aperture when on display in the holder.

10. A retail display unit comprising:

a continuous loop member having a fixed portion, a free portion and a pair of parallel portions that couple the fixed portion to the free portion and define a length of the loop member;

a bracket coupled to the fixed portion of the loop member and configured to mount the loop member to a crossbar on a retail display fixture; and a holder coupled to the pair of parallel portions of the loop member, wherein the holder includes a front, a back, opposing sides, a bottom and configured to hold and display products of different shapes, wherein the bottom of the holder includes a channel having an aperture that extends continuously from the front to the back of the holder.

11. The retail display unit of claim 10, wherein the holder is transparent.

12. The retail display unit of claim 10, wherein the bottom of the holder further comprises a first curved surface and a second curved surface, wherein the channel is located between the first curved surface and the second curved surface and the aperture extends along a bottom of the channel.

13. The retail display unit of claim 10, wherein the holder comprises a plurality of locking features that engage with the pair of parallel portions of the loop member, wherein each locking feature at least partially protrudes from an outer side of the holder.

14. The retail display unit of claim 13, wherein each locking feature comprises a throat and a seat and is configured to snap fit to the loop member.

15. A retail display fixture comprising:

at least one crossbar;

at least one retail display unit configured to hold and display products of different shapes and comprising:

a frame member;

a bracket coupled to the frame member that is configured to mount the frame member to the at least one crossbar; and a holder coupled to the frame member that includes a front, a back, opposing sides, a bottom and is configured to hold and display products of different shapes, wherein the bottom includes a channel that extends from the front to the back of the holder and an aperture located along the entirety of a bottom of the channel, the aperture configured such that a product extends through the aperture when on display in the holder.

16. The retail display fixture of claim 15, wherein the holder is transparent.

17. The retail display fixture of claim 15, wherein the bracket further comprises a notch configured to allow each retail display unit to be mounted to a first crossbar and to a second crossbar that is adjacent to the first crossbar on the retail display fixture.

18. The retail display fixture of claim 15, wherein the bottom of the holder further comprises a first curved surface and a second curved surface, wherein the channel is located between the first curved surface and the second curved surface.

19. The retail display fixture of claim 15, wherein the holder comprises a plurality of locking features that engage with the frame member, wherein each locking feature at least partially protrudes from an outer side of the holder.

* * * * *